US005294283A

United States Patent [19]

D. Guardiola

[11] Patent Number: 5,294,283

[45] Date of Patent: Mar. 15, 1994

[54] AUTOMATIC LABELING MACHINE, FOR CONTAINERS IN THE FORM OF MESH BAGS OR THE LIKE

[75] Inventor: Agustin D. Guardiola, Badalona, Spain

[73] Assignee: Talleres Daumar S.A., Barcelona, Spain

[21] Appl. No.: 971,556

[22] Filed: Nov. 5, 1992

[30] Foreign Application Priority Data

Nov. 11, 1991 [ES] Spain ..... 9102494

[51] Int. Cl.[5] ..... B65C 9/00

[52] U.S. Cl. ..... 156/566; 156/354; 156/517; 156/521; 156/556

[58] Field of Search ..... 156/256, 354, 353, 344, 156/584, 517, 521, 556, 566

[56] References Cited

U.S. PATENT DOCUMENTS 1,955,808 4/1934 Hirschhorn et al. ..... 156/DIG. 23

FOREIGN PATENT DOCUMENTS 0095737 12/1983 European Pat. Off. .
2527807 1/1977 Fed. Rep. of Germany .
2743886 4/1979 Fed. Rep. of Germany .
3234556 5/1984 Fed. Rep. of Germany .
408111 1/1972 Spain .
554613 4/1986 Spain .
399558 10/1992 Spain .

*Primary Examiner*—Michael W. Ball
*Assistant Examiner*—James J. Engel, Jr.

[57] ABSTRACT

An automatic labeling machine, for containers in the form of mesh bags or the like, includes a carriage 18 displaceable back and forth in a support plate 19, which incorporates a central, lengthwise channel 20, two lateral connecting rods 23 and 24 being articulated in the carriage, one with an external stud and the other with a lever 25, joined together at their free ends by means of a brace 26, in which is fixed a finger 27 carrying small catches 28, which can be introduced into the channel 20 with intercalation of the corresponding part of the label to be dragged toward the discharge from the machine; A push rod 32 temporarily retains the stud, provided with a plane **32*a* inclined to the inside in its free end and which can be freed by a bumper 36 joined to the corresponding connecting rod 24, and the lever 25 actuates a cutting device 16**.

1 Claim, 5 Drawing Sheets

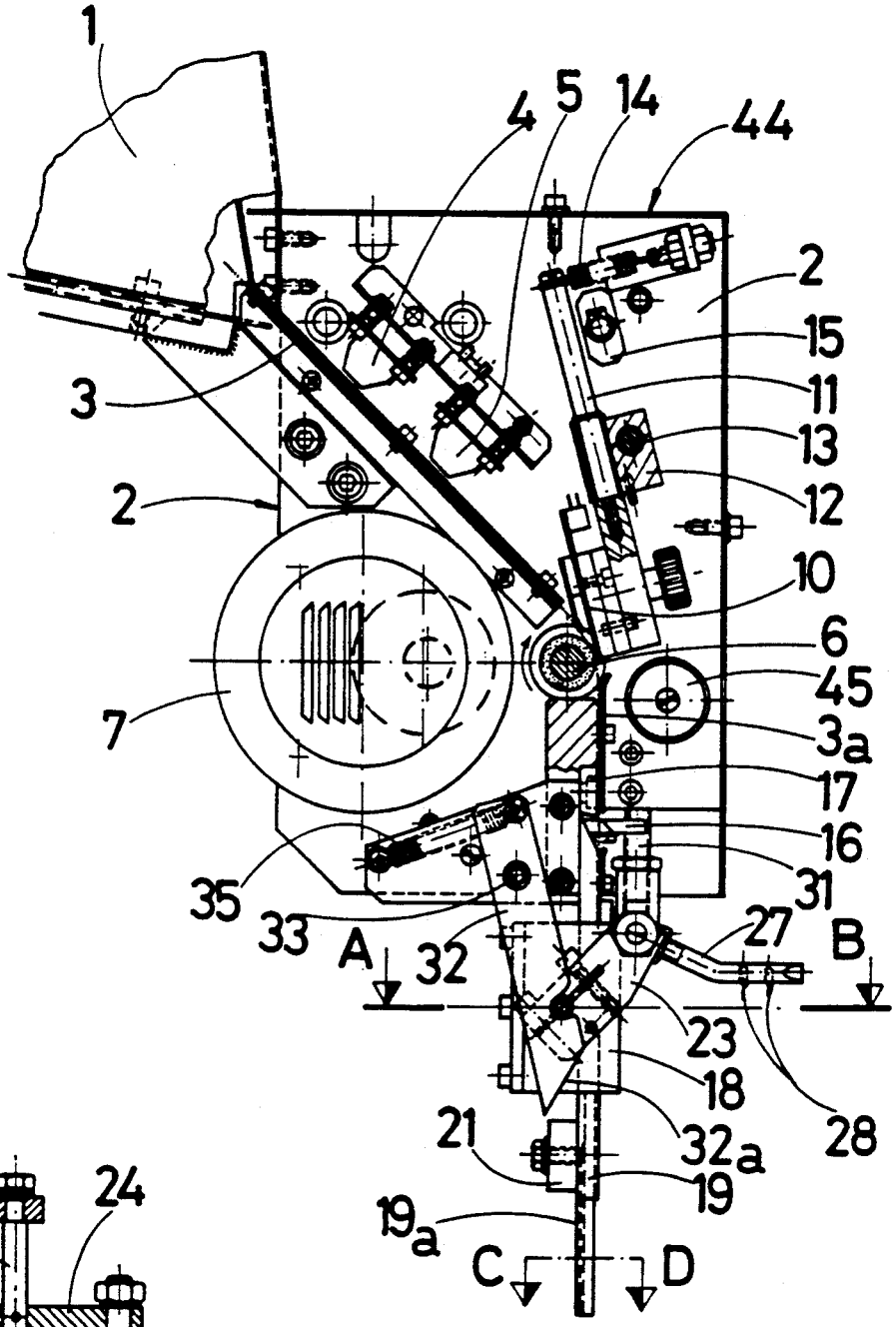
Fig. 1
Fig. 2
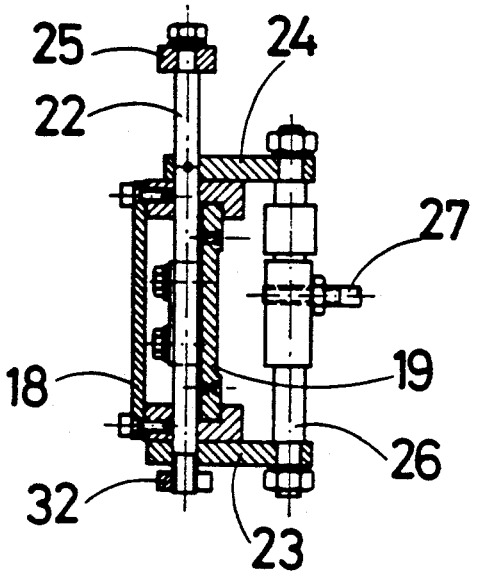
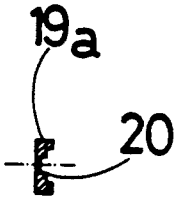
Fig. 3

AUTOMATIC LABELING MACHINE, FOR CONTAINERS IN THE FORM OF MESH BAGS OR THE LIKE

BACKGROUND OF THE INVENTION

1. Field of the Invention

The present invention refers to an automatic labeling machine for containers in the form of bags formed of mesh or the like which, in the function for which it is intended, contributes greater advantages to the process than the other provisions inherent in normal organization and constitution.

2. Description of Related Art

Labeling machines which supply labels in pairs such as the machines which are the object of U.S. Pat. No. 399,558 and its Certificate of Addition No. 408,111, granted to Signors Agustin Dauder Guardiola and Francisco Martinez Martinez, are already known.

The machines which are already known supply labels, in pairs, to clamping devices arranged at the discharge from machines forming product containers in the form of mesh bags or the like, bags which are obtained from a continuous tube of said material, generally plastic material.

The labels are fed from a continuous strip, rolled up in the form of a bobbin and mounted revolving in a suitable support. The cited continuous strip of labels presents two transverse cuts, in the manner of lateral grooves in the strip, which penetrate into part of the width of the strip; Each pair of labels remains joined by means of a cord arranged at the side with each one of the cord's ends fastened to each one of the two labels of the corresponding pair. In the known machines, a guide means guides the cited strip that is unrolled from the bobbin, and means are also present for actuation of said strip to transfer it from the bobbin toward the discharge from the machine and means which cut each pair of labels in order to separate them from the strip supplying them. Regulation and control means are normally provided for the adjustment and operation of the machine.

For this purpose, two clamps are applied which are separated longitudinally at a certain distance from one another and preliminarily hold the cited machine supplying the pair of labels in its proper position. The supplied labels are cut in the separation zone between the two clamps. Each label however, remains joined by means of its cord, one in each end of the pair of bags which are thus closed, in such a manner that alternating and cyclical operations are realized while the successive containers are provided with labels. One label is provided on each side, at opposite ends of the containers.

In the machines supplying labels it is also known to provide them with devices for printing the labels with various informational markings (relative to characteristics of the product in the container, price, etc.), at the same time as the delivery of the labels is carried out, according to various solutions with regard to the printer devices. In the already known machines it is possible to print the labels just before their delivery, that is to say, during the operation of supplying the labels. This method requires a tampon-type device for impregnation of each strip brought up to be transferred for application of the printing to each label, with subsequent complications relating to such printing devices and with the consequential danger that, as a result of the neglect of the user of the machine, the corresponding device can sometimes be found without dye and the labels can be supplied without printing or else with defective printing.

Labeling machines are also known similar to those just described but which supply the labels one by one, each label being provided with an appendix, threaded through at the same time as the body of the label, in order to fix it to the corresponding bag. This operation is carried out during manufacture of such a strip of labels according to the conventional method used to obtain the smallest possible quantity of waste (generally by suitable arrangement of the strips, having an assembly of strips of labels obtained from a band of predetermined width and several times larger in size).

The same petitioner has been granted U.S. Pat. No. 554,613, which refers to a labeling machine of the described type which comprises a bobbin joined to a frame and a feeder of a continuous strip of labels, the labels being separated from one another by at least one transverse cut based on the width of the strip, with each pair of labels being joined by means of a cord or the like arranged laterally and with each one of the cord's two ends fastened, respectively, to each one of the two labels of each pair. The machine also includes a guide means and a means for actuation of said strip, and a cutting means to separate the labels from the strip and a means of regulation and control.

The machine according to U.S. Pat. No. 554,613 is characterized in that it presents an anti-slip surface roller, arranged transverse to the guide means of the strip of labels—which is heat-sensitive—and situated underneath this member, to drag it toward the discharge from the machine. The referenced roller is turned by motor-powered means and through corresponding means of transmission. A printer mechanism working heat selectively at predetermined and programmable points is therefore provided over the turning roller which is applied against the corresponding surface of the strip of labels by an elastic means, for which effect the printer mechanism is articulated on a transverse axis joined to the frame. The axis presents a transverse eccentric means, which revolves actuated by the power means and through the transmission means, which eccentric means periodically produces the swivelling of the printer mechanism, thus periodically elevating it or separating it with respect to the strip of labels. The strip is adapted to be dragged by a temporary transport means, essentially during execution of the separation between each two juxtaposed labels under the active zone of the printer mechanism and presenting to said [printer] mechanism an element for its support over the eccentric means. The temporary transport means are actuated by other eccentric transverses, synchronized with those of the printer mechanism and revolving by the power means through respective transmission means, with another longitudinal support element being applied elastically against said eccentric means, supported and prevented from slipping in the frame, and articulated by its opposite end and in closer proximity to the discharge from the machine to a swiveling transverse support provided with as many catches as transverse cuts exist between each two labels and which can be aligned with the same. The catches are also swiveling, arranged longitudinally, and able to be introduced into said cuts in the strip of labels, to cause the strip to be dragged forward periodically during the inactive phase of the printer mechanism, when it is in its position separated from the referenced strip.

The labeling machine object of U.S. Pat. No. 554,613, among other things, contributes the following advantages: the printer works in a manner which does not interfere with the displacement of the strip of labels; the programming of the points of selective heating of the printer mechanism, to obtain a certain printing on each label, is relatively simple and can be varied as required; the printing, which is executed by heating the heat-sensitive material of the strip of labels, is more precise and is produced with neither spots nor errors and without requiring the use of dyes or the like; and the drawbacks inherent in the use of such printing products, liquid or paste, including the total drying required, are eliminated.

SUMMARY OF THE INVENTION

Nevertheless, the petitioner, by virtue of the petitioner's experience in the exploitation of the aforementioned labeling machines, has designed an automatic labeling machine for containers in the form of mesh bags or the like, of the type described above and coincidentally with the identical part of the labeling machine in agreement with the aforementioned U.S. Pat. No. 554,613.

It is of the type which comprises a bobbin joined to a frame and a feeder of a continuous strip of labels, in particular those joined by very narrow appendices, a guide means to guide said strip, a cutting means to separate the labels from the strip and a means for regulation and control, and also comprising an actuating means to move the strip which presents an anti-slip surface roller, arranged transverse to the guide means guiding the strip of labels and in which said strip is supported so as to be dragged toward the discharge from the machine, the referenced roller turning by virtue of a power means and through corresponding transmission means, making available a printer mechanism, preferably operating heat-selectively, working at predetermined and programmable points, which is applied by elastic means against the corresponding surface, preferably a heat-sensitive surface, of the strip of labels and in the zone in which the opposite surface of said strip is supported above the aforementioned revolving roller, for which purpose the [printer] mechanism is articulated along a longitudinal axis mounted in a transverse axis joined to the frame, and a means can also exist to separate the printer mechanism from the strip as desired.

The present automatic labeling machine is characterized in that it presents a carriage which is displaceable back and forth, by an actuation means, along a support plate projecting downward and secured to the frame, a plate which carries a guide means for the displacement of the terminal label of the strip and a central, longitudinal channel, and with a shaped transverse profile, preferably staggered toward the interior, which extends downward to form an appendix which is also provided with said shaped profile. An axis extends through both sides of the carriage, to which are fastened connecting rods, one on each side, swiveling and contiguous, with respect to one another and on the exterior, one on each of said sides, one end of the axis projecting outward with respect to one of said connecting rods thus forming a stud. A bushing affixed to the stud, while the other end of the axis projects from the other connecting rod and is joined to a lever. The free ends of the two connecting rods are joined securely by a brace, in the intermediate part of which is fixed a finger provided with at least one small catch which can engage with the shaped profile and be introduced into the same with intercalation of the corresponding part of the label, already cut from the strip, for the strip to be dragged toward the discharge from the machine. The actuation means of the carriage is articulated to the brace in which is fixed the finger such that the arrangement includes a retaining push rod, articulated to the frame and provided with a lateral groove into which is introduced the stud of the axis of revolution of the connecting rods. When the carriage is in its position of closest proximity to the cutting means, the push rod being impelled against the stud by elastic means and the retaining push rod presents its free end in a plane inclined into the interior, against which is slid the stud during part of the forward and rearward travel of the carriage. The connecting rod provided with the aforementioned stud includes a bumper situated in forward position with respect to the stud which, when the carriage is moved forward (toward the discharge from the machine), is displaced toward the outside by the retaining push rod, freeing the stud from the groove of that member. During forward movement of the carriage, the lever of the axis of revolution of the connecting rods actuates the cutting means for separation of the corresponding terminal label from the strip of labels through suitable transmission means.

The automatic labeling machine for containers in the form of mesh bags or the like according to the present invention, among other advantages and in addition to having the properties of the labeling machine according to U.S. Pat. No. 554,613, contributes the following advantages: a great versatility in the use of different types of labels, labels either provided with an appendix of narrow width or with no appendix, integration of continuous strips of labels in which the labels are of generally rectangular configuration, of width equal to that of the strip or having other configurations, including polygonal and/or curvilinear body and provided in particular with a narrower appendix, which labels are separated off; and allowing for easy adaptation, by both mechanical and electrical connection, and in particular by a compressed fluid, to the container machine to which the labeling machine is attached.

The labeling machine according to this invention offers the advantages that have been described above in addition to others which are to be deduced easily from the embodiment of the labeling machine which is described in greater detail hereinafter to facilitate comprehension of the characteristics expressed in the preceding, and some drawings of the same are provided to show various details at the same time and to accompany the present specification, in which one practical embodiment of the referenced labeling machine is represented, to be taken solely as a nonlimiting example of the scope of the present invention.

BRIEF DESCRIPTION OF THE DRAWING

In the drawings FIG. 1 shows a side view of the machine with a cross section through a part of the bobbin support and with part of the protective cover removed; FIG. 2 corresponds to the section along A-B of FIG. 1, showing a detail of the carriage of the machine and incorporating its top part with the finger and other elements for better comprehension of the actual construction of the carriage;

FIG. 3 corresponds to the section along C-D of FIG. 1 and shows a detail of the transverse shaped profile of the machine;

DETAILED DESCRIPTION OF PREFERRED EMBODIMENT

The automatic labeling machine, for containers in the form of mesh bags or the like, comprises a bobbin (not shown), which is arranged within a receptacle 1 joined to, or forming part of, a frame 2, which bobbin is constituted of a continuous strip of labels which is fed to the machine, which labels can present any convenient or variously suitable configuration (square, rectangular, curvilinear or with curved sides or combinations of curved and straight sides and, in general, any other form). Each label can also present an appendix of smaller width than that of the body of the label, in such a manner that the narrower appendix serves as linkage between the bodies of the various labels. The bobbin can present a core and can be joined to receptacle 1 or to an equivalent support, with easily dismountable means so that another bobbin can be substituted.

The strip of labels being fed from the bobbin is displaced lengthwise by a guide means 3 and 3*a* guiding the strip, which can consist of two plates arranged parallel and at some distance from one another, forming a sort of a flat, extended tunnel of rectangular transverse section, of which the height is somewhat greater than the thickness of the strip of labels and of which the width is at least somewhat greater than the width of the strip. The bottom plate (FIG. 1) of guide means 3 can present two lengthwise openings, while the top plate will present corresponding openings or else one opening of larger dimensions, covering at least the area of said two openings, so as to arrange one sensor 4 or 5 on each side for each two openings. The sensor position is adjustable in accordance with the dimensions of the body of the label and, in particular in accordance with the dimensions of its appendices, which control the forward movement or the stopping of the strip of labels and the zone of the body of the strip in which the corresponding printing is intended to take place. The means for regulation and control will be connected with those of the container to which they are being applied, for their coordination.

Figure 4:
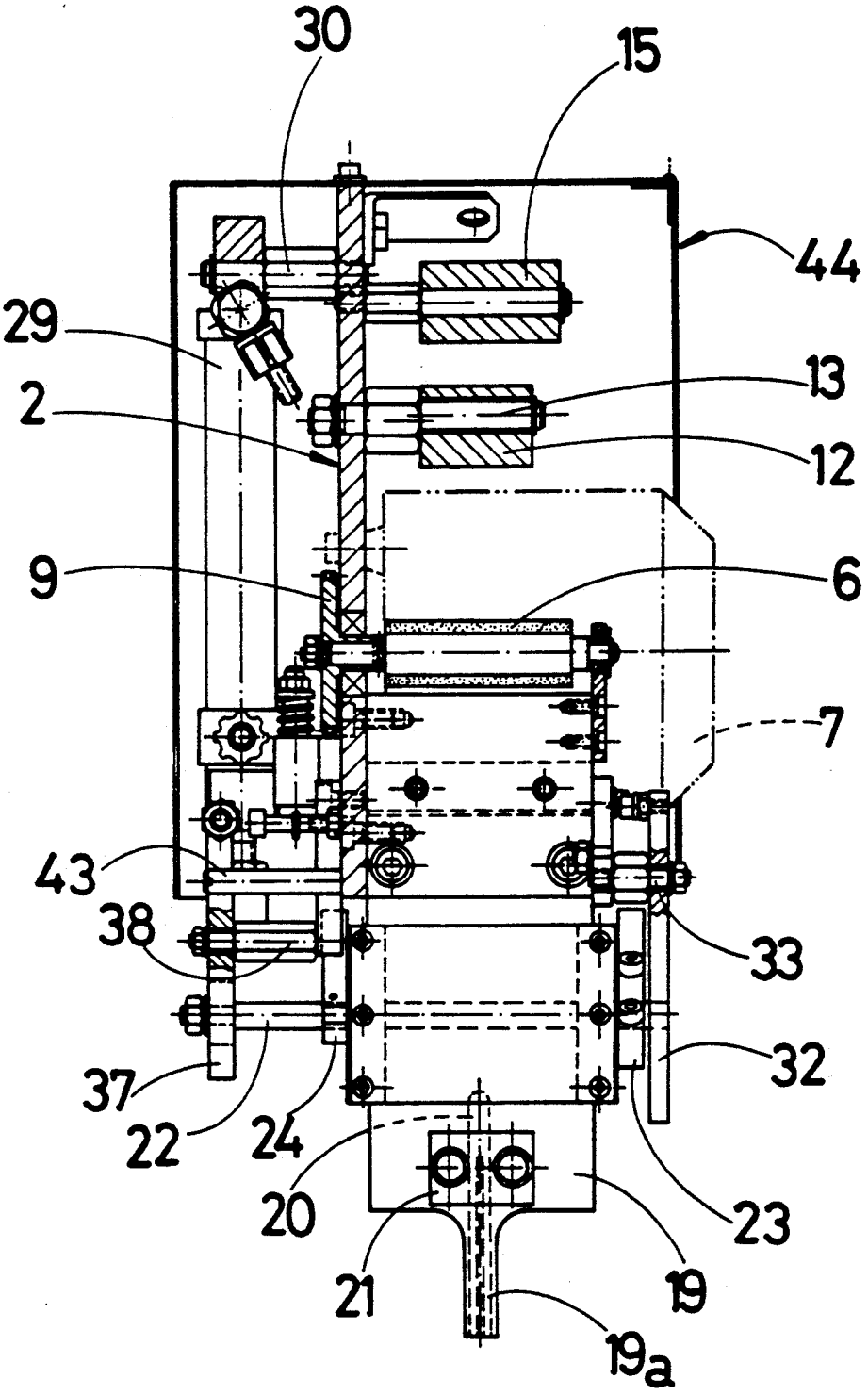
FIG. 4 corresponds to a plan view, turned 90 degrees away from FIG. 1 and with a partial cross section through the dragging roller, with a sketch representation of the actuation motor, which actually is intercalated between the observer and said roller.
Figure 5:
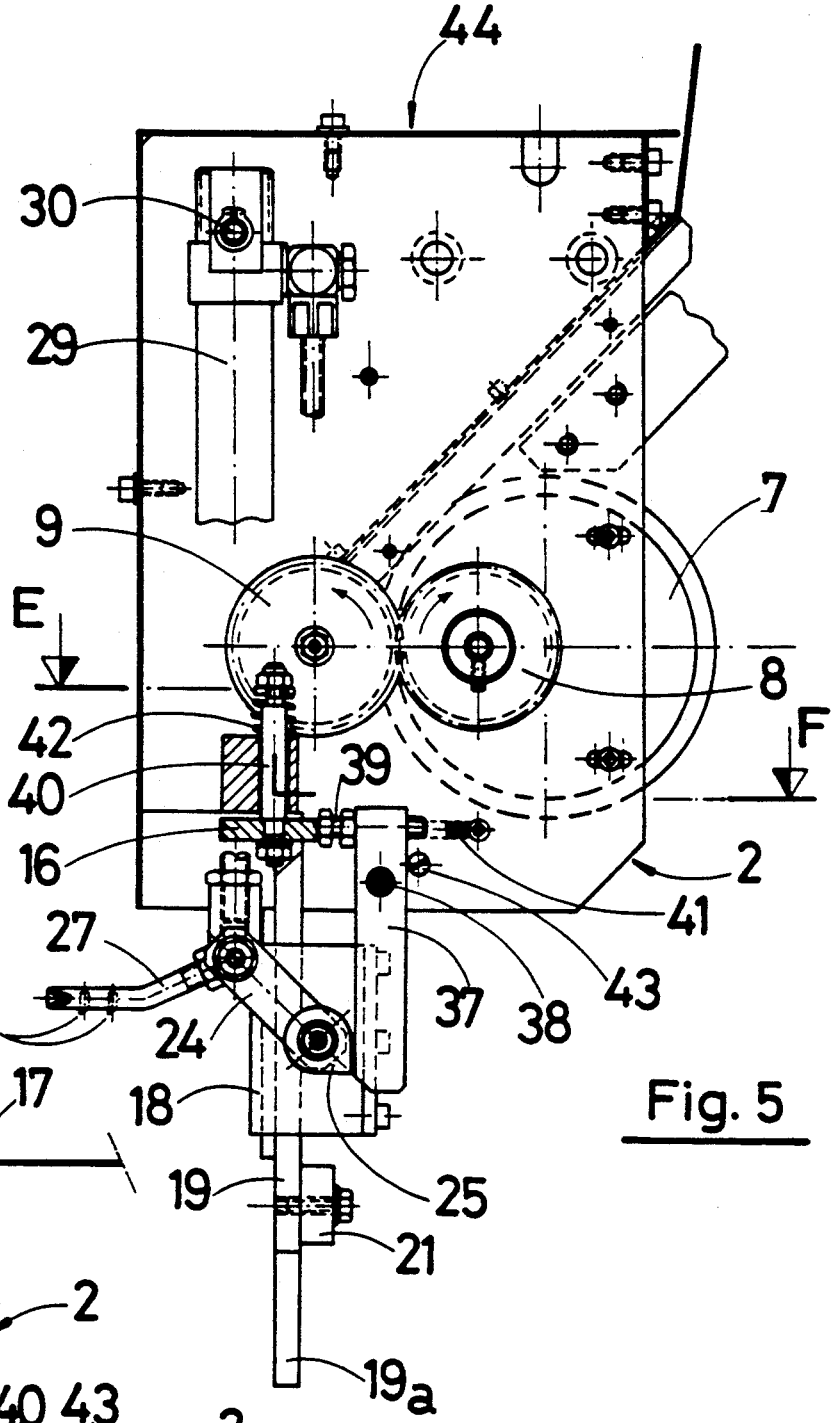
FIG. 5 shows a raised view turned 90 degrees away from FIG. 4, in other words corresponding to a raised view of the side of the machine opposite that shown in FIG. 1 and also with part of the protective cover removed.

The labeling machine presents an actuating means to move the strip which comprises a roller 6 with its anti-slip surface (for example, with a covering of rubber or the like), arranged transverse to guide means 3 and 3*a* guiding the strip of labels and above which the strip is supported to be dragged toward the discharge from the machine. Roller 6 is turned by a power means such as the electric motor 7, which in this case incorporates a reducer and which is joined with the roller through two toothed wheels 8 and 9 (FIG. 5) which gear together, wheel 8 being joined to the discharge of the reducer of electric motor 7 and wheel 9 to roller 6 (FIGS. 4 and 5). In any case, the transmission means between the power means and the aforementioned roller can consist of any other conventional means used for this purpose, which can also be configured as the actuating means causing revolution of the roller by use of any other conventional power means.

The labeling machine which has been described makes use of a printer mechanism 10 which in this example is of the heat selective type operating at predetermined points and is programmable, although the printer mechanism can also consist of a tampon-type device for direct impregnation of the body of each label or else of a transfer strip for its application on top of each label. If printer mechanism 10 operates heat-selectively as described, the surfaces of the labels to be printed must be heat-sensitive to be able to be printed by heat.

In this example, printer mechanism 10 (FIG. 1) is mounted in such a manner that it can revolve along longitudinal axis 11 for improved adjustment of the mechanism over the label to be printed, which is supported at the same time over roller 6. The longitudinal axis 11 is mounted in a block 12 where there is the possibility of its revolution (FIGS. 1 and 4) and the block is articulated on transverse axis 13 joined to frame 2. To be able to hold printer mechanism 10 against the label to be printed and to assure proficient contact and satisfactory printing, the free end of longitudinal axis 11 is joined to a spring 14, and the other end of the axis is fastened suitably to frame 2 in such a manner that its antagonistic elastic action, adjustable as desired, allows this effect to be attained.

One means exists that, in this case, consists of a prismatic block 15, for example of a plastic material and having rounded block edges, which can revolve with respect to a transverse axis fixed to frame 2. In FIG. 1 the frame 2 is in a rest or inactive position and the printer mechanism 10 is applied with pressure against roller 6 (with intercalation of the corresponding strip of labels) by force of the elastic action of spring 14. If the prismatic block 15 is turned (manually) to an angle of 90 degrees with respect to the position represented in FIG. 1, the free end of axis 11 is displaced to the left in the drawing and revolves counterclockwise with respect to axis 13. Therefore, printer mechanism 10 will revolve in the same direction, or as the case may be, to the right in FIG. 1, separating itself from the strip of labels and the roller, so that the user can carry out any desired operation such as the introduction of a new strip of labels from the bobbin. The printer mechanism 10 itself will be able to be joined to its support with means which facilitate its mounting and dismounting and therefore its substitution, and such a printer mechanism will present in particular the suitable electric connections for its actuation.

Figure 6:
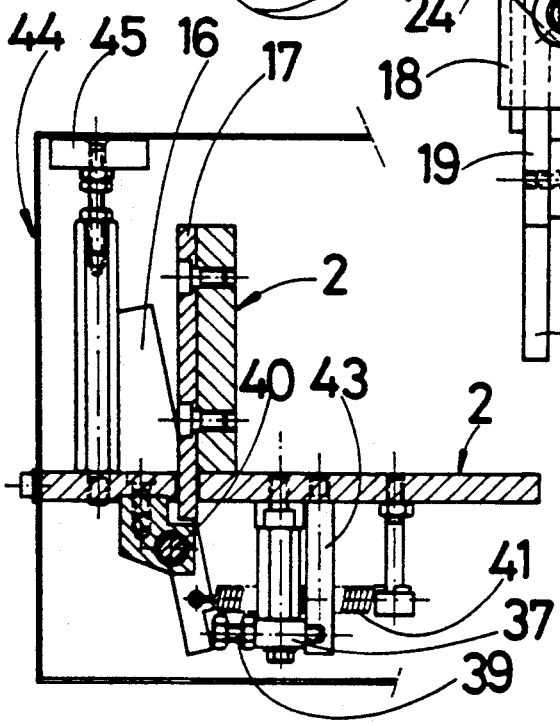
FIG. 6 corresponds to the section along E-F of FIG. 5 and shows a detail of the cutting means and of its actuation.
Figure 7:
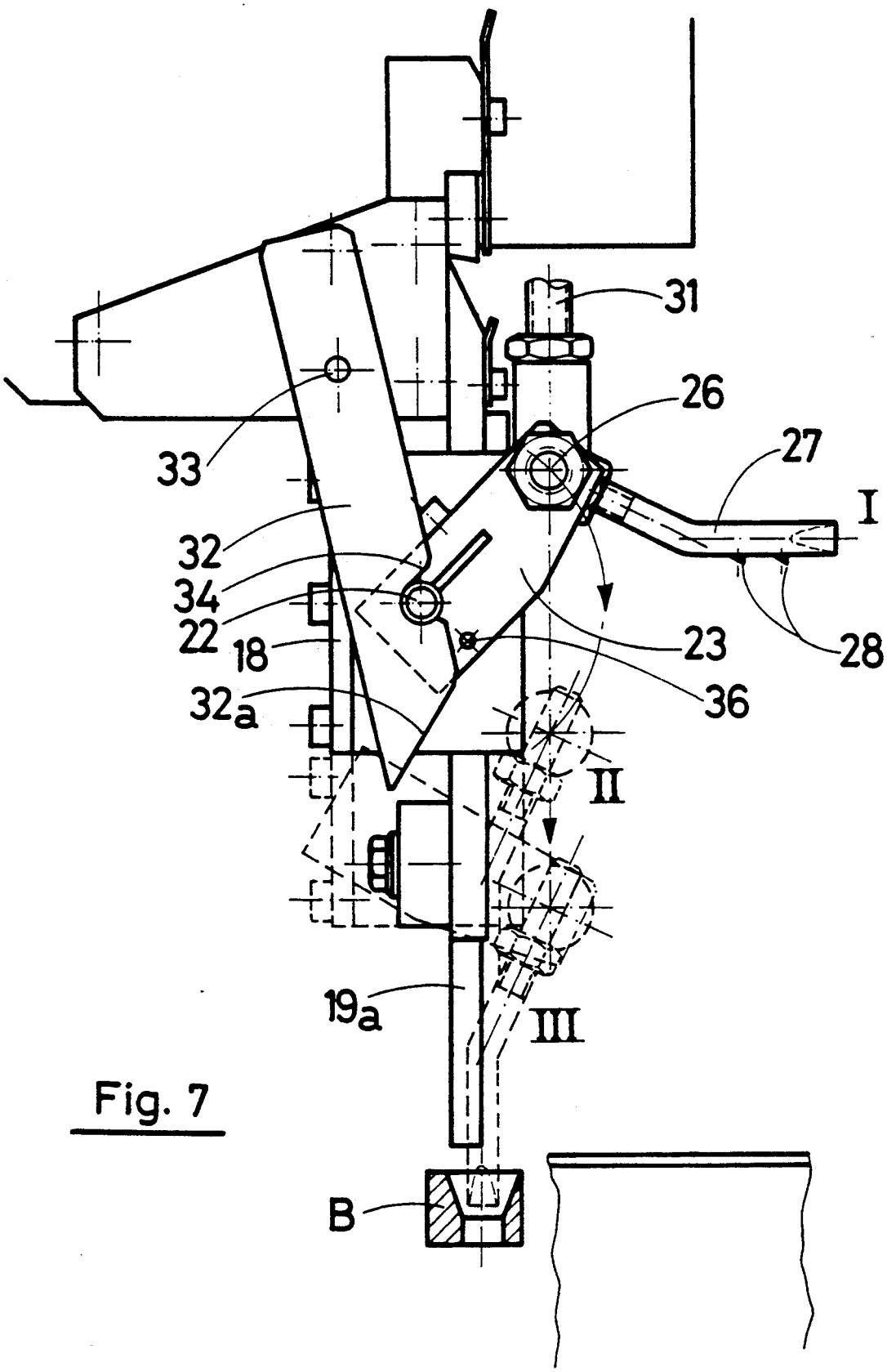
FIG. 7 represents an enlarged detailed view of the bottom part of the machine during its operation for final delivery of the already separated and printed label to the container machine to which it is attached.

Likewise, cutting means are made available to separate each label from the strip, which labels are held together in one assembly (FIGS. 1, 5 and 6) so as to be cut by the movable blade 16 and the blade 17 fixed to frame 2. The actuation of the cutting means is to be described hereinafter.

The labeling machine in question presents a carriage 18 (FIGS. 1, 2, 5, 7 and 8) which can be moved back and forth by an actuation means, along the support plate 19

(FIGS. 1, 2, 4, 5, 7 and 8), which projects downward and is fastened to frame 2. Carriage 18 presents two sides one on each side of support plate 19 which encircle and fit tightly to the vertical sides of the support plate (arranged protruding downward) so that it will be guided correctly (cf. FIG. 2). Channels are formed in lateral sides of the carriage into which are introduced the support plate.

Support plate 19 incorporates a guide means to guide the labels, consisting of a longitudinal recess of a depth and width calibrated to the thickness and width of the strip of labels to be used specifically, the guide means will facilitate the displacement and correct guiding of the terminal label cut from the strip and transferred toward the discharge from the machine to deliver it to the container machine, the feed of which by the labeling machine has just been described. The aforementioned support plate 19 moreover presents a central longitudinal channel 20 (FIGS. 3 and 4) with a shaped transverse profile, in this example staggered toward the interior and which extends forming an appendix 19*a* in a downward direction, likewise provided with the shaped transverse profile. In the bottom of support plate 19, and on its surface opposite that provided by channel 20, is located a bumper 21 to limit the downward displacement of carriage 18.

An axis 22 passes through both sides of carriage 18 (FIGS. 2 and 4) to which are fixed connecting rods 23 and 24, one on each side, which are swiveling and are contiguous, with respect to one another and on the outside, on each one of the two sides of the carriage. The end of axis 22 corresponding to connecting rod 23 projects from the connecting rod in the form of a stud, advantageously provided with a bushing or the like affixed to the same, and the opposite end of the axis 22 projects for a certain distance with respect to the other connecting rod 24 and carries a lever 25 (FIGS. 2 and 5) fastened thereon.

The free ends of the two connecting rods 23 and 24 are joined securely by a brace 26 (FIG. 2), in which is fixed a finger 27 which, in this example, is constituted by a small rod folded at an obtuse angle (FIGS. 1, 5, 7 and 8). The referenced finger can be of any other convenient profile, and can even be of circular configuration corresponding to the shape of a small rod. Finger 27 incorporates two small catches 28, although this number can be varied in agreement with the requirements and therefore it will have at least one small catch, which catches are susceptible of being placed face-to-face with the shaped transverse profile of central channel 20 of plate 19 with its appendix 19*a*. The catches can be introduced into the shaped profile with intercalation of the corresponding part of the label, already cut off from the strip, to be dragged toward the discharge from the machine and supplied to the container. The free end of finger 27 in the drawings forms an angle of 90 degrees with respect to the vertical plane of support plate 19, and the angle will be variable in agreement with the dimensions of the labels to be printed and subjected by the labeling machine to the corresponding container to which it is fed.

The actuation means actuating carriage 18 are constituted in this example of a double-action pneumatic cylinder 29 (FIGS. 4 and 5) which is articulated on the axis 30 attached to frame 1. The small rod 31 of cylinder 29 is articulated on brace 26 (FIG. 2 and in general, FIGS. 1, 5, 7 and 8). The actuation means for the carriage can involve other conventional solutions which attain the alternating or back and forth displacement of the carriage and consequently of finger 27 fixed to brace 26, with a movement of the finger which is to be described hereinafter.

The retaining lever 32 is articulated to frame 2 through the axis 33 and presents a lateral groove 34 (FIGS. 7 and 8 and also visible in FIG. 1), into which is introduced the stud of the corresponding end of connecting rod 23 of axis 22, when carriage 18 is in its position of closest proximity to cutting means 16 and 17, that is, in the highest level position in its back and forth travel. The retaining lever 32 is thrust against the referenced stud by an elastic means which, in this case, consists of spring 35 which is joined to the top end of lever 32 and fixed to frame 2 (FIG. 1).

Retaining push rod 32 presents its free end (which is the bottom end in the drawings) in an inclined plane 32*a* (FIGS. 1, 7 and 8), against which is slid the referenced stud during part of the forward and return travel of carriage 18.

Connecting rod 23 incorporates a bumper 36 (FIGS. 7 and 8, and visible in FIG. 1), which is situated in a forward position (further down and toward the discharge from the machine) with respect to the stud. When the carriage is advancing toward the discharge from the machine (actuated by small rod 31 of pneumatic cylinder 29), the connecting rod is displaced toward the outside by retaining push rod 32 (overcoming the antagonistic action of spring 35) and in this manner liberating the stud from groove 34 of the retaining push rod.

During the forward movement of carriage 18, lever 25 of axis 22 acts in the sense of cutting through corresponding transmission means, causing separation of the corresponding terminal label from the strip of labels. The transmission means, in this example, consists of a push rod 37 articulated on axis 38 affixed to frame 2 of the machine (FIG. 5). The opposite end of push rod 37 presents a clamping screw 39 (FIGS. 5, 6) which projects from the push rod for an adjustable distance during which the mechanism is supported against the end of movable blade 16, which is articulated through axis 40 to frame 2 and is maintained an open position by spring 41 whose antagonistic action can be overcome by the angular movement (toward the left, that is, in counterclockwise direction in FIG. 5) of push rod 37, at the same time actuated by lever 25. Likewise, movable blade 16 is held against fixed blade 17 by the elastic action of spring 42. A bumper 43 is present to limit the travel, in clockwise direction in FIG. 5, of push rod 37 and, finally, to limit the maximum angle of opening of movable blade 16.

A protective cover 44 can be provided over the machine, and it is important that this member comprise a fixed part which covers the part of the machine corresponding to the transmission mechanisms and other mechanisms. This part of the cover is fastened with conventional means over the vertical wall of frame 2, while the cover also comprises a swiveling part, joined for example by hinges or the like to the already described stationary part and which will cover the remaining part of the machine with the printer mechanism and the transport means, among other members, to facilitate rapid opening of the swivelable part of the cover and to permit access to the parts of the machine. The user of the machine can thereby intervene in operations for instance to correct the arrangement of the strip of labels in order to initiate the operation of the labeling machine and feed labels to the corresponding container machine. In this example, the swiveling part is held closed by means of a magnetic clasp 45 (FIGS. 1 and 6), although the clasping can also be attained by any other conventional means used for this purpose.

The operation of the labeling machine is easily understood by an expert from the description and from the drawings to which reference is made in the description, to obtain the feed of the strip of labels, the printing one by one and the cutting for separation of each terminal label with respect to the strip of labels delivered one by one, into the input of the container in the form of a mesh bag or the like to which said automatic labeling machine is attached. The operation synchronized with the operation of the tube of mesh material to obtain the corresponding bag, with the pick-up and incorporation of each label thus delivered, for its integral assembly with the bag which is already closed and containing the suitable product. A brief description of the operation of this labeling machine, especially with reference to FIGS. 1, 5, 7 and 8, is provided in summary hereinafter.

Once the bobbin of the strip of labels and receptacle 1 are arranged by the user and the strip is drawn out, guided by guide means 3 and 3*a*, the strip, supported over anti-slip roller 6 and revolving prismatic block 15 in such a manner that it passes to the position shown in FIG. 1. In other words, printer mechanism 10 is applied over the corresponding surface of the label which is to be printed (the labeling machine being connected to the corresponding container machine, by its synchronization). Electric motor 7 can be started up and, thus driven, the aforementioned roller 6 is revolved, displacing the strip of labels downward until sensors 4 and 5 actuate pneumatic cylinder 29 (FIGS. 4 and 5) or the pneumatic cylinder is actuated by control of the container (in which are integrated the signals of said sensors), and its small rod 31 is moved, being displaced downward producing the downward movement of carriage 18. Consequently, the clockwise revolution (FIG. 7) of connecting rod 23 and also of connecting rod 24 (this member revolving counterclockwise, as shown in FIG. 5), is such that the stud of axis 22 is thrust against the bottom of groove 34, at the same time finger 27 is revolved in clockwise direction. Continuing this downward displacement of carriage 18 by the actuation of small rod 31, bumper 36 comes to establish contact with retaining push rod 32, causing displacement in a clockwise direction (to the left in FIG. 7), until the stud of axis 22 projects from groove 34 and is freed of the retaining action of push rod 32. Finger 27 passes from its initial position I to position II, at which moment the label which is already printed and which has been cut from the strip, since the revolution of connecting rods 23 and 24 produce simultaneous revolution of axis 22 to which they are affixed. Consequently, revolution of lever 25 in a counterclockwise direction is also produced, as shown in FIG. 5, and the lever must swivel in a counterclockwise direction as compared with push rod 37, which thrusts movable blade 16 against stationary blade 17 (FIGS. 5 and 6), simultaneously producing the separation cut of the already preprinted terminal label with respect to the strip of labels. Subsequent to displacement, carriage 18 is lowered with finger 27, of which the small catches 28 are applied against the label or its appendix, if it has one. The central part of the carriage is introduced into channel 20 of support plate 19 (thus adopting a channeled configuration in transverse section) and consequently traveling over the channel of its appendix 19*a* toward delivery of said label, position III, within the mouthpiece B of the container machine, for the fixation of said label with a catch or the like to the corresponding shaped bag which has already been filled with the desired product in the container machine.

Figure 8:
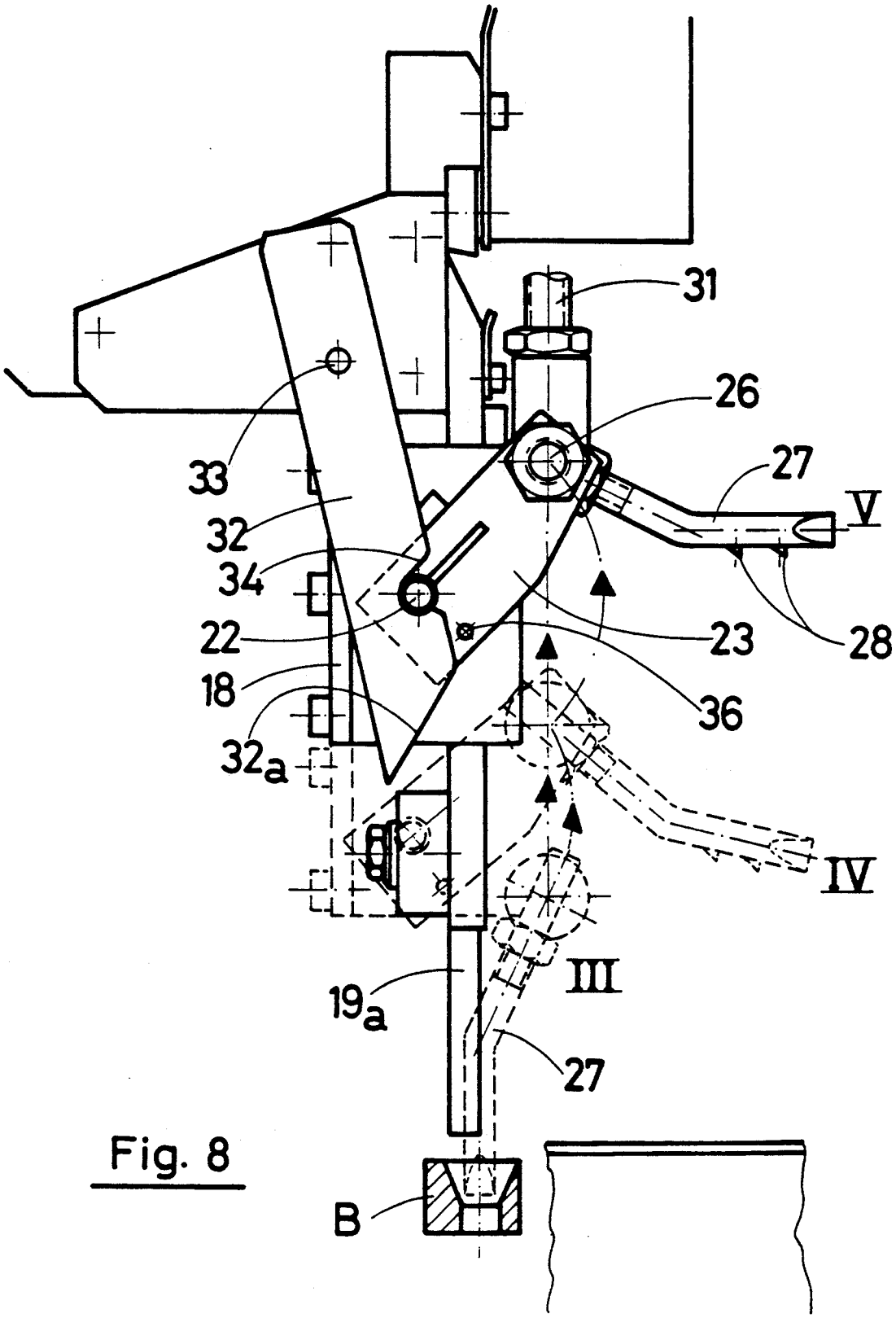
FIG. 8 is a representation similar to that of FIG. 7, but showing the removal of the carriage from the machine and the movement described by the finger with small catches, joined to the carriage of the machine.

FIG. 8 shows the pulling back of carriage 18, actuated by small rod 31, which now moves in downward displacement and in which during each return process finger 27 executes a revolution in clockwise direction, passing from position III to an intermediate position such as position IV. Following the ascent of carriage 18 the stud of axis 22 comes to be supported against the inclined plane 32*a* of retaining push rod 32, displacing it in a clockwise direction in FIG. 8 until the stud manages to squeeze into groove 34, in which it remains held by virtue of the antagonistic action of spring 35 (FIG. 1). Thus, the process described for delivery of a new label into mouthpiece B can be initiated once again. It is appropriate to indicate that, during the return or rising movement of carriage 18, lever 25 is held in an inactive position, as is shown in FIG. 5, whereby movable blade 16 is held open during all of this pulling back movement.

I claim:

1. An automatic labeling machine for containers in the form of bags of mesh or the like, of the type which comprises a bobbin joined to a frame and fed with a continuous strip of labels, in particular labels joined by very narrow appendices, guide means for guiding said strip, cutting means for separating labels from the strip, a regulation and control device, actuation means having an anti-slip surface roller for moving the strip traverse to the guide means of the strip of labels and in which is supported said strip to be dragged toward a discharge end of the machine, said roller revolving in response to power means and through corresponding transmission means, making available a printer mechanism, preferably printing heat-selectively at predetermined and programmable points, which is applied against a corresponding surface, preferably a heat-sensitive surface, of the strip of labels by elastic means and in the zone in which the opposite surface of said strip is supported above the aforementioned revolving roller, to which the printer mechanism is articulated along a longitudinal axis mounted in a transverse axis joined to the frame, and means for separating the printer mechanism from the strip; characterized in that said labeling machine includes a carriage displaceable back and forth by an actuation device along a support plate projecting downward and fixed to the frame, the support plate holding guide means for guiding the displacement of the label of the strip and a central, longitudinal channel, with a shaped transverse profile, preferably staggered toward an interior, which extends forming an appendix facing downward and also provided with said shaped profile;

an axis passing through both sides of the carriage, to which are affixed connecting rods on each side, swivelling and contiguous, with respect to one another and on the outside, on each one of said sides, one end of the axis projecting out with respect to one of such connecting rods thus forming a stud, said stud being provided with a bushing fixed to the same, while the other end of the axis projects out from the other connecting rod and is joined to a lever;

a brace member securely joining free ends of the two connecting rods;

a finger provided in the middle of the brace with at least one small catch which can come face-to-face with the shaped profile and be introduced into the same with intercalation of the corresponding part of the label, already cut from the strip, to be dragged toward the discharge from the machine;

wherein the actuation means for the carriage are articulated to the brace in which is fixed the finger for presenting a retaining push rod, articulated to the frame and provided with a lateral groove into which is introduced the stud of the axis of revolution of the connecting rods, whereby when the carriage is in its position most proximate to the cutting means, and said push rod is being thrust against said stud by an elastic means, the retaining push rod presents its free end following a plane inclined to the inside, against which is slid the stud during part of the forward and return travel of the carriage;

wherein the connecting rod provided with the aforementioned stud also has a bumper situated in a forward position with respect to the stud wherein, when the carriage moves forward (toward the discharge from the machine), the bumper is displaced to the outside by the retaining push rod, freeing the stud from the groove of that member; and wherein during the forward movement of the carriage, the lever of the axis of revolution of the connecting rods actuates the cutting means for the separation of the corresponding terminal label from the strip of labels across corresponding transmission means.

* * * * *